US008905381B2

(12) United States Patent
Slob

(10) Patent No.: US 8,905,381 B2
(45) Date of Patent: Dec. 9, 2014

(54) HOISTING ASSEMBLY

(75) Inventor: Wouter Johannes Slob, Den Haag (NL)

(73) Assignee: Heerema Marine Contractors Nederland SE, Leiden (NL)

( * ) Notice: Subject to any disclaimer, the term of this patent is extended or adjusted under 35 U.S.C. 154(b) by 376 days.

(21) Appl. No.: 13/390,417

(22) PCT Filed: Aug. 27, 2010

(86) PCT No.: PCT/NL2010/050536

§ 371 (c)(1),
(2), (4) Date: Apr. 23, 2012

(87) PCT Pub. No.: WO2011/025375

PCT Pub. Date: Mar. 3, 2011

(65) Prior Publication Data

US 2012/0199800 A1 Aug. 9, 2012

Related U.S. Application Data

(60) Provisional application No. 61/237,784, filed on Aug. 28, 2009.

(30) Foreign Application Priority Data

Aug. 28, 2009 (NL) ..... 2003406

(51) Int. Cl.
*B66D 1/50* (2006.01)
*B66C 23/12* (2006.01)
*B66D 3/04* (2006.01)

(52) U.S. Cl.
CPC ..... *B66D 3/043* (2013.01); *B66C 23/12* (2013.01); *B66D 3/04* (2013.01)
USPC ..... 254/273; 254/275; 254/399; 212/272

(58) Field of Classification Search
CPC ..... B66C 23/12; B66C 13/04; B66D 3/04; B66D 3/043; B66D 3/08
USPC ..... 254/268, 273, 275, 281, 285, 395, 397, 254/399; 212/272, 281
See application file for complete search history.

(56) References Cited

U.S. PATENT DOCUMENTS 1,436,608 A * 11/1922 Rodier ..... 254/399
2,546,683 A * 3/1951 Young ..... 254/399

(Continued)

FOREIGN PATENT DOCUMENTS

DE 3736287 A1 9/1988
EP 0312337 A1 4/1989

(Continued)

OTHER PUBLICATIONS

English Machine Translation of DE 3736287 A1.

*Primary Examiner* — Emmanuel M Marcelo
(74) *Attorney, Agent, or Firm* — Hoffmann & Baron, LLP

(57) ABSTRACT

A hoisting assembly for lifting or lowering a heavy object includes an upper fixed block, an upper movable block being suspended from the upper fixed block by at least one first rope which is reeved into one or more first rope lengths between the upper fixed block and the upper movable block, a lower movable block being connected to the upper movable block by at least one second rope which is reeved into one or more second rope lengths between the upper fixed block and the upper movable block. The first and second ropes are reeved in such a way that in use the upper movable block can be positioned at a distance greater than zero from the upper fixed block and at a distance greater than zero from the lower movable block by controlling the lengths of the first and second ropes.

16 Claims, 5 Drawing Sheets

(56) References Cited

U.S. PATENT DOCUMENTS

| | | | | |
|---|---|---|---|---|
| 3,263,965 | A * | 8/1966 | Mutch | 254/281 |
| 3,469,820 | A * | 9/1969 | Horton | 254/277 |
| 4,098,492 | A * | 7/1978 | Wilkinson | 254/399 |
| 4,343,458 | A * | 8/1982 | Simon | 254/399 |
| 4,403,766 | A * | 9/1983 | Schmeider | 254/399 |
| 4,721,286 | A | 1/1988 | Hey et al. | |
| 4,850,571 | A * | 7/1989 | Cabanos | 254/392 |
| 4,976,143 | A * | 12/1990 | Casso | 73/152.45 |
| 5,538,223 | A * | 7/1996 | Scace et al. | 254/399 |
| 6,496,765 | B1 | 12/2002 | Robinett, III et al. | |
| 6,651,961 | B1 | 11/2003 | Meyer | |
| 6,926,259 | B1 | 8/2005 | Roodenburg et al. | |
| 7,416,169 | B2 * | 8/2008 | Noeske et al. | 254/275 |
| 7,917,293 | B2 * | 3/2011 | Newman | 702/6 |
| 7,963,579 | B2 * | 6/2011 | Waisanen | 294/82.12 |
| 8,550,267 | B2 * | 10/2013 | Lee et al. | 212/319 |
| 2003/0231733 | A1 * | 12/2003 | Weber et al. | 376/272 |
| 2011/0214856 | A1 * | 9/2011 | Newman | 166/250.01 |
| 2012/0109526 | A1 * | 5/2012 | Conine et al. | 702/6 |
| 2012/0123757 | A1 * | 5/2012 | Ertas et al. | 703/2 |
| 2013/0032358 | A1 * | 2/2013 | Newman | 166/377 |

FOREIGN PATENT DOCUMENTS

| | | |
|---|---|---|
| GB | 1269778 | 4/1972 |
| GB | 2005218 A | 4/1979 |

* cited by examiner

HOISTING ASSEMBLY

CROSS-REFERENCE TO RELATED APPLICATIONS

This application is the National Stage of International Application No. PCT/NL2010/050536, filed Aug. 27, 2010, which claims the benefit of Netherlands Application No. 2003406, filed Aug. 28, 2009 and U.S. Provisional Application No. 61/237,784, filed Aug. 28, 2009, the contents of all of which are incorporated by reference herein.

FIELD OF THE INVENTION

The present invention relates to a hoisting assembly, in particular for use in offshore engineering. In the field of offshore engineering, heavy loads must often be hoisted or lowered. These operations are typically performed from a location above the sea level, such as from a vessel or a fixed platform.

DISCUSSION OF THE PRIOR ART

A problem encountered in heavy lifting in a marine environment is that vertical (or axial) resonance may occur in the system. The hoisting assembly, in combination with the heavy object which is hoisted, may form a mass-spring system in which the hoisting assembly functions as a spring and in which the heavy object forms the mass.

This hoisting assembly has a natural frequency (or resonance frequency) which is determined by the following equation:

$$f = \frac{1}{2\pi}\sqrt{\frac{k}{M}} = \frac{1}{2\pi}\sqrt{\frac{\frac{EA}{L}}{M}}$$

where M is the mass, k is the spring coefficient, E is the E modulus, A is the cross-sectional area of the cable and L the length of the cable.

For a cable with a constant E and A, the spring constant k changes with the lowering depth L. Changing of the spring constant k also means a change of the natural frequency f.

Due to different causes, external excitations may be exerted on the system. In a case wherein the hoisting assembly is mounted on a vessel, a cause of the excitation may be the action of waves at the water surface which moves the vessel up and down. This movement is transferred to the hoisting assembly and the load. Another cause may be water movements below the surface, such as currents. Other kinds of excitations are also possible, such as excitation from the lifting or lowering process itself, for instance changes in the vertical speed of the load.

Under certain conditions, the natural frequency of the system which is outlined above may become the same as the frequency of excitations. In this case, resonance may occur and the heavy object may start to undergo substantial movements. This is a drawback of known heavy lifting systems.

When the frequency of excitations is substantially the same as the natural frequency of the hoisting assembly, the response of the hoisting assembly to the pattern of excitations may result in the object starting to move up and down in a springing manner. The amplitude of this movement may increase and result in danger for the material and even in damage to—or loss of—material and/or the object being lifted/lowered. Danger for personnel may also be involved. The movements may result in high peak loads in the ropes of the hoisting assembly, which peak loads may exceed a breaking load, causing the rope to break.

It is therefore desired to ensure that the response of the hoisting system to the pattern of the excitations is avoided or at least reduced, in order to avoid resonance.

One aspect of this phenomenon is that the natural frequency of the hoisting assembly will vary in dependence of the depth of the load, i.e. in dependence of the distance of the load to the vessel. When the load is close to the vessel and the ropes are short, the system has a relatively high natural frequency. When the object is lowered to the seabed, the natural frequency of the system gradually decreases.

If the natural frequency would always be the same, it would be possible to construct a hoisting assembly with a substantially different natural frequency than anticipated excitations. This would guarantee a mild response of the hoisting system under all circumstances. However, since the natural frequency varies, it is difficult to obtain a natural frequency of the hoisting assembly which will not lead to resonance problems at any depth.

EP0312337 shows a hoisting assembly of the prior art. FIGS. 1J-1L show a system having a block and tackle assembly 15. This arrangement provides the benefit of a greater range of hoisting, see column 1, lines 55-57 of EP0312337. EP0312337 does not teach anything on resonance or on prevention or reduction of resonance problems.

OBJECT OF THE INVENTION

It is an object of the invention to provide an alternative to the prior art.

It is another object of the invention to provide a hoisting assembly in which vertical resonance is substantially limited.

It is yet another object of the invention to provide a hoisting assembly which allows a user to controllably vary the response of the hoisting assembly with a suspended load to excitations.

It is another object of the invention to upgrade an existing conventional lowering system in order to increase the lowering depth of the lowering system.

SUMMARY OF THE INVENTION AND FURTHER EMBODIMENTS

At least one of the above mentioned objects is achieved in a hoisting assembly for lifting or lowering a heavy object, the hoisting assembly comprising:

an upper fixed block, an upper movable block being suspended from the upper fixed block by at least one first rope which is reeved into one or more first rope lengths between the upper fixed block and the upper movable block, a lower movable block being connected to the upper movable block by at least one second rope which is reeved into one or more second rope lengths between the lower movable block and the upper movable block, wherein the first and second ropes are reeved in such a way that in use the upper movable block can be positioned at a distance greater than zero from the upper fixed block and at a distance greater than zero from the lower movable block by controlling the lengths of the first rope and the second rope.

The invention is particularly suitable for marine hoisting operations, above the water level or under water. When a load is suspended under water, the upper movable block and lower movable block may also be positioned under water.

The lower movable block generally comprises a connection device for suspending a heavy load. The connection device may be a hook or eye or similar device.

The invention works by varying the equivalent spring coefficient of the total hoisting assembly in a controlled fashion. Each rope length in the system is considered to act as a spring. Each spring (or rope length) has a spring coefficient. Together, the rope lengths form a combined spring having a combined (or equivalent) spring coefficient.

The stiffness of the separate masses (movable blocks including hook load) of the hoisting assembly is very important as well. There is an interaction between the various masses in the system. The separate movements of these masses within the system influence each other since they are connected. There is a relation between the masses and the stiffness's available within the system, and the location of these masses.

By controlling or varying the position of the upper movable block between the upper fixed block and the lower movable block, the rope lengths in the system are varied, and the equivalent spring coefficient can be varied in a controlled fashion. This can be used to optimise the response of the hoisting assembly to an expected range of excitations.

If the range of excitations on the system is known, the position of the upper movable block within the hoisting assembly can be chosen such that the response of the system is optimized for the circumstances. In this way, resonance may be avoided or reduced.

In one embodiment, it is possible to use the invention for substantial water depths, i.e. the rope lengths are sufficiently long to support a heavy load at water depths of several thousands of meters.

A skilled person will understand that wherever the word rope is used, a wire, a line, a cable or chain or any other similar means may also be used. With a wire, a line, a cable or a chain, the invention will work in substantially the same way.

Steel wires may be used.

However, synthetic wires are gradually used more often in the field of the art and it is also envisaged that the ropes may be synthetic wires. Synthetic wires are generally more elastic than steel wires, i.e. have a smaller elasticity modulus E.

The ropes may be reeved in various ways through the blocks. The lower movable block is connected to the upper movable block via at least one rope length. The lower movable block will generally be connected directly to the upper fixed block via at least one rope length, which extends from the upper fixed block to a winch or other drive.

It is observed that prior art is known in which a splittable block is provided. See U.S. Pat. No. 4,721,286. In this system, an upper fixed block 50, an upper movable block 76 and a lower movable block 74 are provided. The lower movable block 74 is suspended from the upper movable block 76. The upper movable block 76 is thus positioned between the upper fixed block 50 and the lower movable block 74.

The system of U.S. Pat. No. 4,721,286 has two modes of operation. In a first mode, the upper movable block 76 is fixed to the upper fixed block 50. In this mode, the system can lift or lower relatively light loads with a substantial speed. In a second mode of operation, the upper movable block 76 is fixed to the lower movable block 74. In the second mode of operation, relatively heavy loads can be lifted or lowered at a relatively low speed.

The difference in speeds and weights of the loads to be lifted in the first and second mode is related to the number of ropes between the upper fixed block and the upper movable block and between the upper movable block and the lower movable block, respectively. The number of ropes between the upper fixed block and the upper movable block is greater than the number of reevings between the upper movable block and the lower movable block.

The system of U.S. Pat. No. 4,721,286 is limited to providing these two different hoisting modes for light weights and heavy weights. There is no teaching in U.S. Pat. No. 4,721,286 which relates to resonance or improvements in the avoidance of resonance.

More particularly, the system of U.S. Pat. No. 4,721,286 does not provide a possibility of positioning the upper movable block at any other position than in engagement with the upper fixed block or in engagement with the lower movable block. In U.S. Pat. No. 4,721,286, the position of the upper movable block can not be chosen independently of the lower movable block, because a rope is reeved through both the upper movable block and the lower movable block.

Conversely, in an embodiment of the present invention, the position of the upper movable block can be varied while keeping the lower movable block in a same position. In addition to varying the equivalent spring coefficient, the advantage of U.S. Pat. No. 4,721,286 may be obtained in one or more suitable embodiments of the invention.

In one embodiment, the first rope is manufactured from a different material than the second rope. A different material may have a different elasticity modulus E and thus result in different spring behaviour. Additionally a different material may have a different density. When this density is lower than steel, the depth to which a load can be lowered is increased, because the weight of the cable itself is lower than the weight of a steel cable and thus does not decrease the lifting capacity with depth as would be the case with a steel cable.

In a suitable embodiment of the present invention, the position of the upper movable block is variable between the upper fixed block and the lower movable block by varying the lengths of the first and second ropes.

In an embodiment, the first rope has a different factor E*A than the second rope.

The first rope may have a different elasticity modulus E than the second rope, and/or the first rope may have a different cross-sectional surface area A than the second rope.

It is also possible that the spring coefficient only differs due to the fact that the number of rope lengths between the upper fixed block and the upper movable block differs from the number of rope lengths between the lower movable block and the upper movable block and between the lower movable block and the upper fixed block. In this embodiment, the first and second ropes may be completely identical, i.e. have a same elasticity modulus E and cross-sectional area A.

A combination is also possible, i.e. a different number of rope lengths between the upper fixed block and the upper movable block on the one hand and between the upper movable block and the lower movable block on the other hand in combination with a first rope which has a different elasticity modulus E and/or cross-sectional area A than the second rope.

In an embodiment, a substantially larger number of rope lengths extend between the upper fixed block and the upper movable block than between the upper movable block and the lower movable block.

Generally, the first rope is not reeved between the upper movable block and the lower movable block. Generally, the second rope is not reeved between the upper fixed block and the upper movable block.

In an embodiment, at least one rope length of the second rope extends from the lower movable block directly to the upper fixed block.

In another embodiment, at least one rope length of the second rope extends from the upper fixed block through one or more openings in the upper movable block to the lower movable block, wherein the openings are constructed in order to allow a movement of the second rope through the upper movable block without exerting substantial vertical forces on the upper movable block.

In this embodiment, the second rope is guided through the upper movable block in such a way that a possible horizontal swaying of the second rope is substantially reduced.

In an embodiment, the hoisting assembly comprises a data processing unit configured to receive:

excitation data relating to external excitations on the hoisting assembly and hoisting assembly data relating to the response characteristics of the hoisting assembly to external excitations, the data processing unit being configured to determine a favourable position of the upper movable block between the fixed block and lower movable block on the basis of the excitation data and the hoisting assembly data, which favourable position results in a limited vertical resonance of the hoisting assembly to the external excitations.

In an embodiment, the data processing unit is configured to receive and process hoisting assembly data comprising:

a weight of the upper movable block and a weight of the lower movable block, a weight of the object to be lifted, an elasticity modulus of the first and second rope, a cross-sectional area of the first and second rope, a configuration of the reevings of the first and second rope between the fixed block, the upper movable block and the lower movable block, a depth of the lower movable block.

With these data, the response characteristics of the hoisting assembly can be accurately determined.

In an embodiment, the hoisting assembly comprises:

at least one sensor for measuring excitation data relating to excitations on the hoisting assembly and the load which is lifted, and/or an estimate data input configured to receive estimate data relating to predicted or estimated behaviour of wind and waves, currents and/or data relating to a vessel on which the hoisting assembly is positioned, the data processing unit being configured for computing excitation data on the basis of the estimate data and using said excitation data for determining a favourable position of the upper movable block.

With this embodiment the frequency pattern of excitations can be determined and the hoisting assembly can be controlled to limit vertical resonance.

Measurements can be performed with the sensor to measure actual excitations. The sensors can be a motion sensor, a wind sensor, a wave sensor, a sensor for measuring the current. The sensor can be placed on the hoisting assembly or on the vessel on which the hoisting assembly is positioned. The sensor can also be located remote from the hoisting assembly, for instance on a nearby vessel.

It is also possible to input predictions or estimated values of wind, waves, currents and other parameters which are relevant for the excitation on the hoisting assembly. Thus, actual measurements need not be performed. A combination of measured parameters and estimated or predicted parameters may also be used.

In another embodiment, the hoisting assembly comprises at least one plate which projects from the upper and/or lower block and which forms a damping mechanism in combination with the surrounding water when the upper and/or lower block moves through the water. The plate extends substantially horizontally.

With the damping mechanism, resonance may be further reduced in a simple way. The plate is moved through the water and increases the friction of the upper and/or lower movable block.

A skilled person will understand that the damping plate may also be provided on a single movable block in a hoisting assembly having only a single movable block.

The present invention also relates to a method of lifting or lowering a heavy object, the method comprising:

providing a hoisting assembly comprising:

an upper fixed block, an upper movable block being suspended from the upper fixed block by at least one first rope which is reeved into one or more first rope lengths between the upper fixed block and the upper movable block, a lower movable block being connected to the upper movable block by at least one second rope which is reeved into one or more second rope lengths between the lower movable block and the upper movable block, wherein the first and second ropes are reeved in such a way that in use the upper movable block can be positioned at a distance greater than zero from the upper fixed block and at a distance greater than zero from the lower movable block, positioning the upper movable block at predetermined positions between the upper fixed block and the lower movable block by controlling the lengths of the first and second rope.

The method according to the invention has substantially the same advantages as the hoisting assembly discussed above.

In a suitable embodiment, the method comprises varying the position of the upper movable block independently from the position of the lower movable block by varying the lengths of the first and second ropes.

In another embodiment, the method comprises controlling a spring coefficient of the total hoisting assembly between the upper fixed block and the lower movable block by controlling the position of the upper movable block between the upper fixed block and the lower movable block.

In another embodiment, the method comprises controlling the spring coefficient of the first rope lengths and second rope lengths by varying the distances between the upper fixed block and the upper movable block and between the first rope lengths and lower movable block in such a way that the response of the system to a range of frequencies of excitations is reduced.

In another embodiment, the method comprises:

a) determining a frequency pattern of excitations on the hoisting assembly and object which is lifted;

b) providing the upper movable block at a position which results in a response to the pattern of excitations which is substantially reduced when compared to at least one other possible position of the movable block.

With the method, the response of the hoisting assembly can be substantially less than the response of a standard hoisting assembly in the same circumstances. Here, a standard hoisting assembly Is considered to comprise a single movable block and form a mass-spring system having one degree of freedom.

With the use of an upper movable block and a lower movable block, the response pattern changes from a response pattern having one peak at a certain frequency to a response pattern having two peaks at different frequencies, Generally, the two peaks will be lower than the single peak of a hoisting assembly having a single movable block.

The frequency pattern of the excitations may be calculated or measured with sensors, such as movement sensors on board the vessel and/or on the hoisting assembly.

In one embodiment, the method comprises positioning the upper movable block at a plurality of positions between the upper fixed block and the lower movable block during a lowering or a lifting operation of a heavy object under water.

In an embodiment, the method comprises:

providing a data processing unit, inputting excitation data, inputting hoisting assembly data and determining a favourable position of the upper movable block between the fixed block and lower movable block on the basis of the excitation data and the response data, which favourable position results in a limited vertical resonance of the hoisting assembly to the external excitations.

In another embodiment, the method comprises:

measuring excitation data relating to actual excitations on the hoisting assembly and the load which is lifted and/or receiving estimate data relating to predicted or estimated behaviour of wind and waves, currents and/or data relating to a vessel on which the hoisting assembly is positioned, and computing excitation data on the basis of the estimate data, and using the excitation data for computing a favourable position of the upper movable block.

The position of the upper movable block may be gradually changed during a lifting or lowering operation.

The invention is explained in more detail in the text which follows, with reference to the drawings, which show a number of embodiments, which are given purely by way of non-limiting examples.

DETAILED DESCRIPTION OF THE INVENTION

Figure 1:
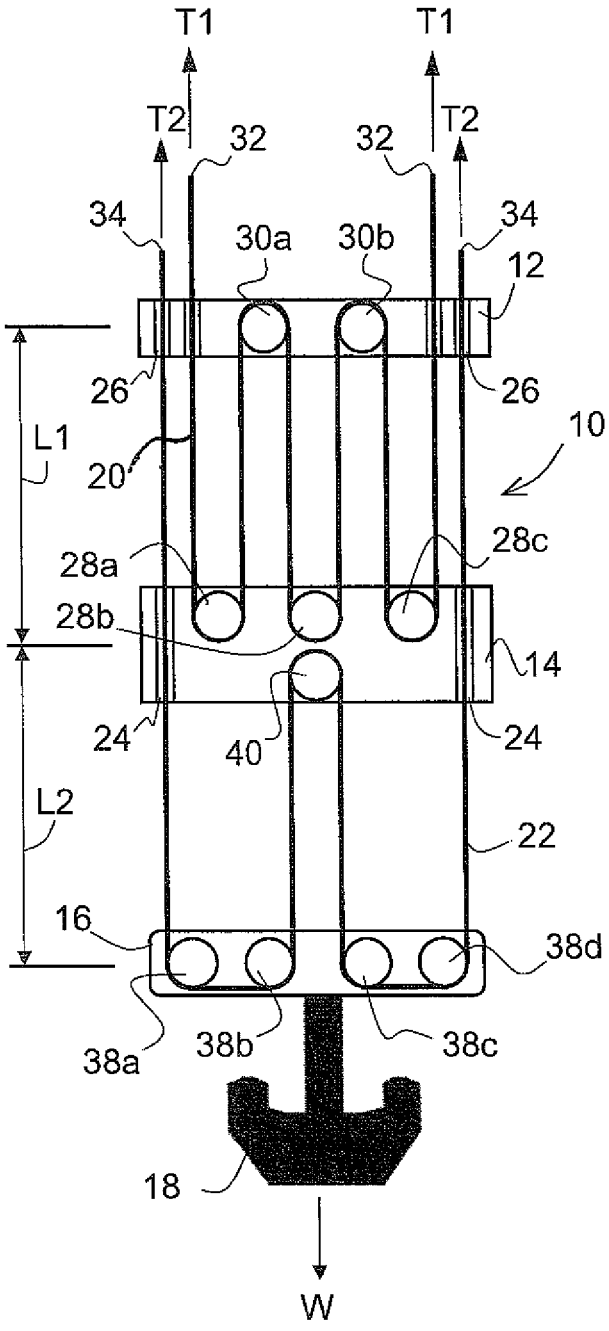
FIG. 1 shows a diagrammatical side view of the hoisting assembly according to the invention.
Figure 2:
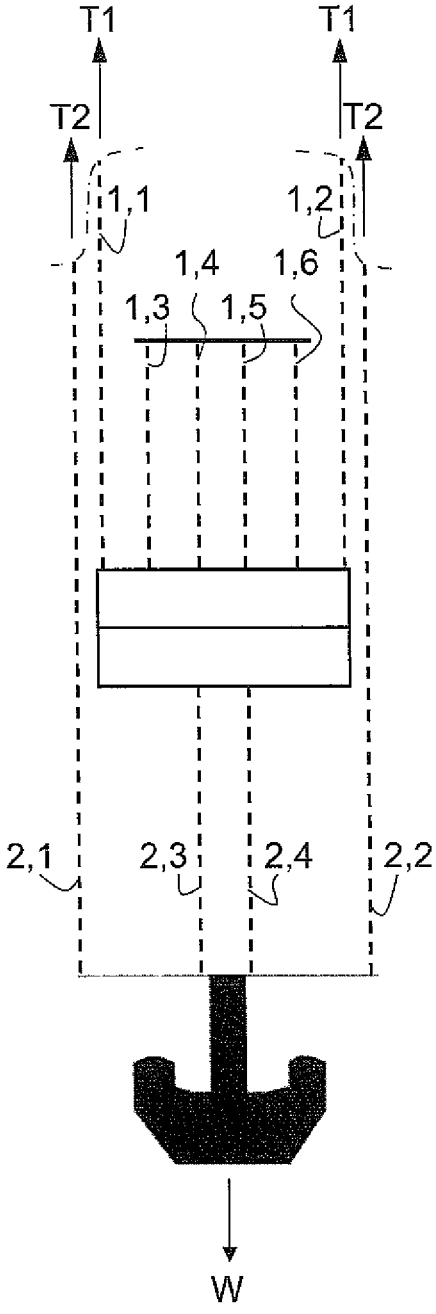
FIG. 2 shows a diagrammatical scheme of the rope lengths of the hoisting assembly of the invention.

Turning to FIGS. 1 and 2, a hoisting assembly 10 according to the invention is shown. The hoisting assembly 10 comprises an upper fixed block 12, an upper movable block 14, and a lower movable block 16. The lower movable block 16 generally comprises a connector 18 which is constructed to support a heavy load (not shown). The connector 18 may be a hook or an eye, or any other device suitable for suspending a heavy load. In the Figures, the heavy load is denoted with an arrow and the symbol 'W'.

The upper fixed block 12, the upper movable block 14 and the lower movable block 16 are elements which are known in the field of the art. The upper fixed block 12 may be directly mounted on a hull of a vessel (not shown), or may be mounted on a crane-like structure (not shown) which is positioned on a vessel. The upper fixed block 12 may be supported above a moon pool on a vessel, or mounted on the vessel at the stern or bow in a position over the water. Other ways of positioning the hoisting assembly are also possible.

A first rope 20 is provided which is reeved through the upper fixed block 12 and the upper movable block 14.

A second rope 22 is provided, which is reeved through the lower movable block 16, and extends through openings 24 in the upper movable block 14. The first rope 20 is reeved over three sheaves 28*a*, 28*b*, 28*c* in the upper movable block 14, and over sheaves 30*a*, 30*b* in the upper fixed block 12.

Sheaves are known in the field of the art and can have several different forms. Generally, a sheave is a roller which rolls about an axis. Generally, the sheaves will be non-driven but driven sheaves are also possible.

The ends 32 of the first rope 20 are connected to a winch (not shown) which is driven by a drive, such as an electrical drive. Winches are known in the field of the art. The ends 34 of the second rope 22 are also connected to a winch and a drive in a similar way as the ends 32 of the first rope 20. The winch may be of the type with a driven drum, a traction winch or any other kind of winch.

Generally, the first rope 20 and second rope 22 will be guided to the respective winches via one or more sheaves which are mounted in the upper fixed block 12. However, it is also possible that the winches are mounted directly on the upper fixed block 12. The ends 32, 34 are connected to a device which is separate from the upper fixed block 12, such as a sheave or winch mounted above the upper fixed block 12.

The upper fixed block 12 may be mounted to the tip of a crane. It is also possible that the upper fixed block 12 is positioned at a distance below the tip of a crane.

The second rope 22 is reeved via sheaves 38*a*, 38*b*, 38*c*, 38*d* in the lower movable block 16, and via a sheave 40 in the upper movable block 14.

The upper movable block 14 is shown at a distance L1 from the upper fixed block 12. The lower movable block is shown at a distance L2 from the upper movable block 14.

The length of the first rope 20 can be varied independently from the length of rope 22. In this way, distances L1 en L2 can be chosen independently from one and other.

Turning to FIG. 2, the rope lengths extending between the upper fixed block 12, upper movable block 14 and lower movable block 16 are shown in a diagrammatical form. Rope lengths 1,1, 1,2, 1,3, 1,4, 1,5 and 1,6 extend between the upper fixed block 12 and the upper movable block 14. Thus, a total of six rope lengths extend between the upper fixed block 12 and the upper movable block 14. The rope lengths 2,1, 2,2, 2,3, 2,4 extend upwards from the lower movable block 16.

In order to make use of the double-block principle at least one sheave 40 needs to connect the upper movable 14 block with the lower movable block 16.

Calculation of the Forces in the Ropes

The force acting in the first rope 20 is indicated with $T_1$ in FIG. 1. The force acting in the second rope 22 is indicated with $T_2$ in FIG. 1. The forces are axial forces.

The tension force in the different ropes can be calculated according to the number of vertical lines taken up in the design and shown in FIG. 2. The formulae by which $T_1$ and $T_2$ may be calculated in the show embodiment are:

$$W = Load_{Total} \cdot g$$

$$T_2 = \frac{W}{\text{nr_wires_line}_2}$$

-continued $$T_1 = T_2 \cdot \frac{(\text{nr_wires_line}_2 - 2)}{(\text{nr_wires_line}_1 - 2)}$$

$$P = T_1 \cdot (\text{nr_wires_line}_1 - 2)$$

The parameter $\text{nr_wires_line}_2$ indicates the number of rope lengths extending upwards from the lower movable block 16, i.e. 2,1-2,4, four rope lengths.

The parameter $\text{nr_wires_line}_1$ indicates the number of rope lengths extending between the upper movable block 14 and the upper fixed block 12, including the rope lengths 2,1 and 2,2 which do not exert a vertical force on the upper movable block 14.

From FIG. 2, it can be seen that, in the specific reevings shown, of the total force W which is exerted by the load on the lower movable block 16, one half will be transferred via rope lengths 2,1 and 2,2 directly to the upper fixed block 12. The other half of force W will be transferred to the upper movable block 14 via rope lengths 2,3 and 2,4. This same other half of force W will be transferred from the upper movable block 14 to the upper fixed block 12 via rope lengths 1,1-1,6. In the specific embodiment shown in FIGS. 1 and 2, the force in the first rope 20 will be one third (⅓) of the force in the second rope 22. Thus, $T_2=3\times T_1$.

It will be clear to a person skilled in the art that the above formulae will result in a different outcome when a different reevings arrangement is used.

Calculation of Equivalent Spring Coefficient

In the invention, the ropes lengths are considered to form springs. The equivalent spring coefficient for the entire hoisting system is calculated from the spring coefficients of the individual springs (or rope lengths).

It can be seen that in the shown embodiment, six rope lengths, i.e. 1,1-1,6, extend between the upper fixed block 12 and the upper movable block 14. Two rope lengths, i.e. 2,3 and 2,4, extend between the upper movable block 14 and the lower movable block 16. Additionally, two rope lengths 2,1 and 2,2 extend between the lower movable block 16 and the upper fixed block 12.

All the rope lengths 1,1-1,6 and 2,1-2,4 may be assumed to be functioning as a spring. The shown embodiment thus is a combination of parallel springs and springs in series. Springs 1,1-1,6 are coupled in parallel with one another. Springs 2,3-2,4 are also coupled in parallel with one another. Springs 1,1-1,6 are coupled in series with springs 2,3-2,4. Springs 1,1-1,6 and springs 2,3-2,4 are coupled in parallel with springs 2,1-2,2.

For each spring (or rope length), the spring coefficient is:

$$k = \frac{E \cdot A}{L},$$

with E being the Elasticity modulus, A the cross-sectional area, and L the length of the rope length in question.

For the shown embodiment, the following equivalent spring coefficient for the various parts of the hoisting system are (see also FIG. 6):

$$k_{1,eq} = k_{1,1} + k_{1,2} + k_{1,3} + k_{1,4} + k_{1,5} + k_{1,6}$$

$$k_{2,eq} = \left(\frac{Ltot}{Ltot + L2}\right) * (k_{2,1} + k_{2,2})$$

-continued $$k_{3,eq} = \left(\frac{L2}{Ltot + L2}\right) * (k_{2,3} + k_{2,4})$$

Figure 6:
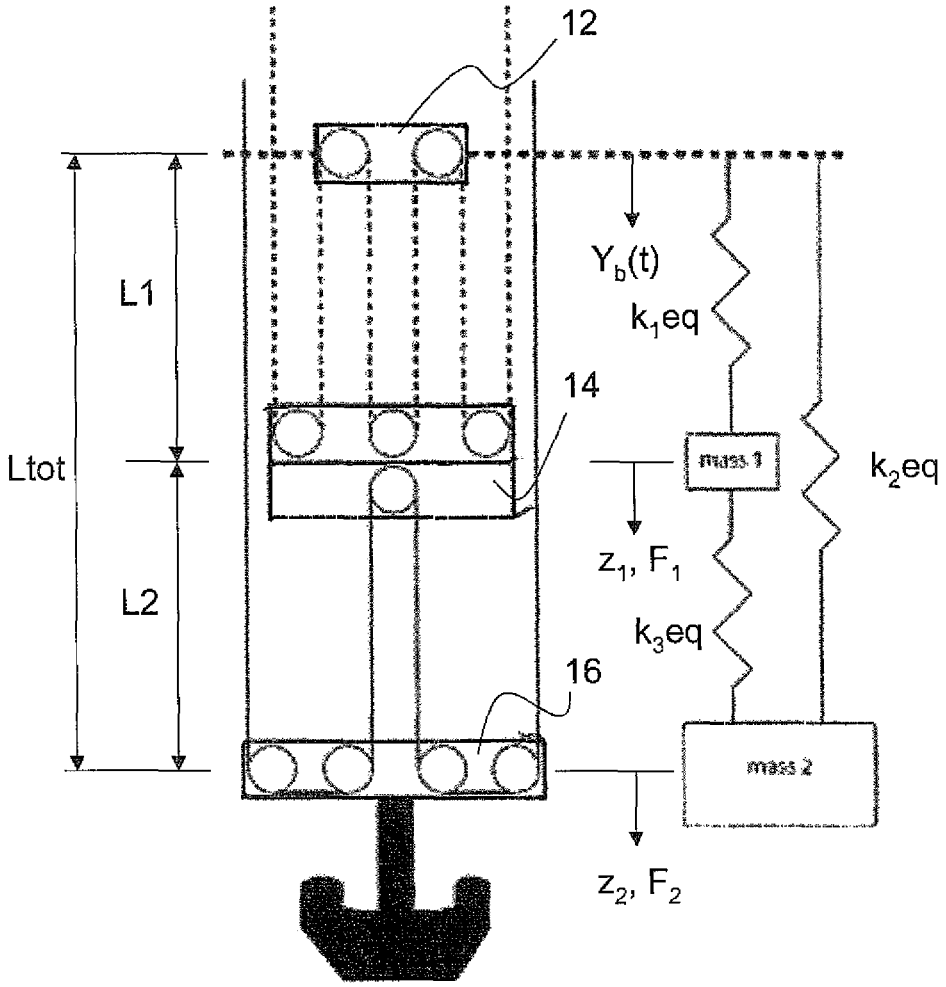
FIG. 6 shows a schematic representation of the mass spring system of an embodiment according the invention.

In FIG. 6, upper movable block 14 is represented as mass 1. A force F1 acts on this mass, causing a displacement z1. The lower movable block 16 is represented by mass 2. This mass is subjected to force F2 and displacement z2. The upper fixed block 12 is loaded by yb(t) which represents the movement in top of the system, for instance movement of the tip of the crane on the vessel.

If in use the length of first rope 20 is increased, the length of springs 1,1-1,6 increases. This would lead to a lower position of the upper movable block 14 and the lower movable block 16. If the length of the second rope 22 is decreased, the length of springs 2,1-2,4 is decreased. The net result of the variations in the rope lengths may be that the lower movable block 16 remains in the same position, but that the length of all the springs in the system is different, with the upper movable block 14 being in a different position. The equivalent spring coefficient k of the new arrangement will be different, resulting in a different response to excitations.

For the shown embodiment, the total rope length of the first rope 20 below the upper fixed block 12 is: 6*L1

For the shown embodiment, the total rope length of the second rope 22 below the upper fixed block 12 is: 2*L1+4*L2

The equivalent spring coefficient may be determined (or varied) by varying the distances L1 and L2.

A skilled person will understand that many other embodiments of the reevings are possible between the upper fixed block 12, upper movable block 14 and lower movable block 16.

With the present invention, the hoisting assembly can be continuously tuned during a lowering and lifting operation by adjusting the relative lengths of the different ropes and by controlling the distances L1 and L2. The relative lengths can be adjusted while the total length is kept constant. In this manner, the natural frequency of the hoisting system can be adjusted or tuned. When the natural frequency of excitations is known, the natural frequency of the hoisting system can be chosen such that it is substantially different from the natural frequency of the excitations.

In the embodiment of FIGS. 1 and 2, the ropes 20, 22 are kept at a distance from one another such that there is no risk or only a limited risk of twisting and entanglement of the rope lengths.

In operation, the lower movable block 16 is to be raised or lowered over a certain distance. This raising or lowering operation may be performed by moving the lower movable block 16 relative to the upper movable block 14, or by moving the upper movable block 14 relative to the upper fixed block 12.

If the lower movable block 16 is moved relative to the upper movable block 14, a relatively fast movement of the lower movable block 16 is possible, due to the relatively small number of rope lengths extending between the lower movable block 16 and the upper movable bock 14. In this way, a relatively light load may be lowered or hoisted at a substantial speed.

When a very heavy load is to be lowered or raised, the upper movable block 14 can be fixed to the lower movable block 16 and both attached blocks can be moved together. Due to the larger number of rope lengths extending between the upper fixed block 12 and the upper movable block 14, a greater load can be raised or lowered.

Figure 3:
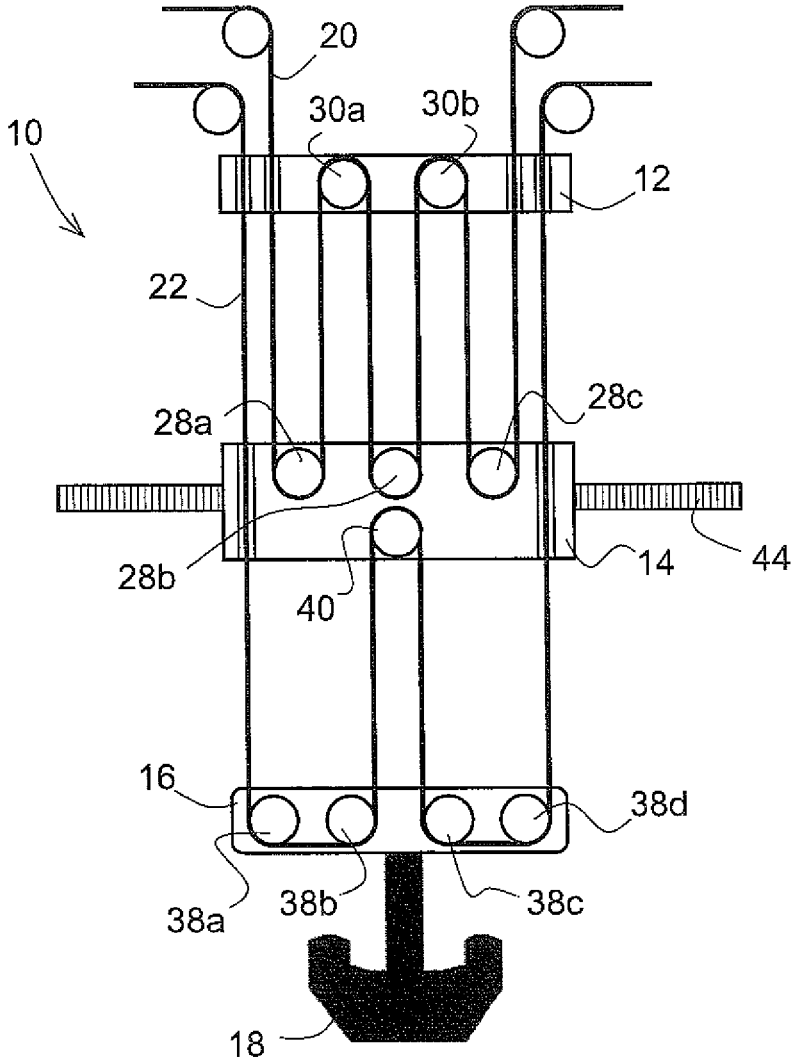
FIG. 3 shows a diagrammatical side view of another embodiment of the invention.
Figure 4:
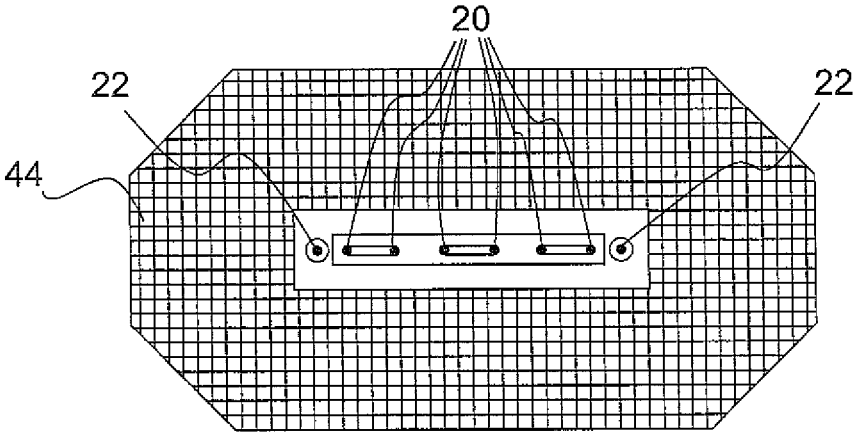
FIG. 4 shows a diagrammatical top view of the embodiment of FIG. 3.

Turning to FIGS. 3 and 4, an alternative embodiment of the present invention is shown, further comprising a damping plate 44. The damping plate 44 is connected to the upper movable block 14 and extends around the upper movable block 14. The damping plate extends substantially horizontally. When the upper movable block 14 moves upwards or downwards, the damping plate 44 moves through the water and resists the movement of the upper movable block due to the inertia of the water above and/of below the damping plate. This causes a damping effect on the upward or downward movement of the upper movable block 14. The damping plate 44 thus has a dampening effect on any resonance. A damping plate 44 may also be applied on the lower movable block. It will be apparent to a person skilled in the art that the damping plate 44 can be applied on other hoisting assemblies which are known in the prior art.

Figure 5:
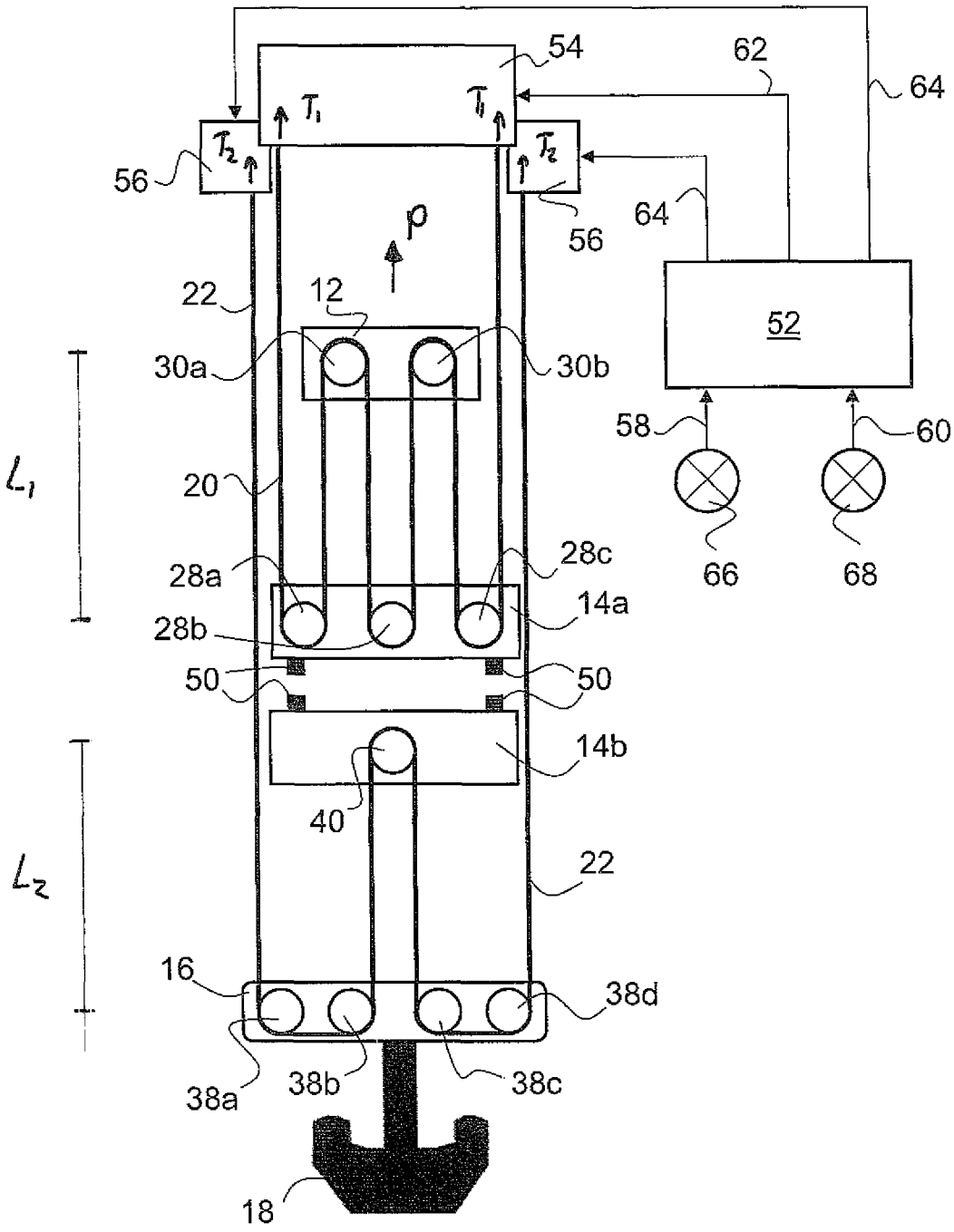
FIG. 5 shows a diagrammatical side view of another embodiment of the invention.

FIG. 5 shows an embodiment in which the upper movable block 14 can be split into an upper block section 14A and a lower block section 14B. The lower block section 14*b* is shown as being at a distance from the lower movable block 16, but in practice the lower block section 14*b* will generally be resting on the lower movable block 16 when disconnected from the upper block section 14A. The effect of splitting the block 14 is that a conventional hoisting system is obtained with only one block, i.e. lower movable block 16.

Connection means 50 are provided for connecting and disconnecting upper block section 14A to and from lower block section 14B.

Further, the embodiment of FIG. 5 has an upper fixed block which is narrower than the upper fixed block of FIGS. 1-4, with the result that the ropes 20, 22 are not guided through openings 26, but pass at a distance from the upper fixed block 12.

Likewise, block sections 14A and B are narrower than upper movable block 14 of the embodiment of FIGS. 1-4, such that line 22 passes at a distance from the upper and lower block sections 14A and 14B.

FIG. 5 further shows a data processing unit 52, a first drive 54 for driving the first rope 20 and a second drive for driving the second rope 22. The data processing unit 52 comprises an excitation data input 58 for receiving excitation data on the system. The data processing unit comprises hoisting assembly input for receiving data on the hoisting assembly. The data processing unit is configured to determine a favourable position of the upper movable block 14 on the basis of these data. Via control lines 62 and 64, the drives 54, 56 are controlled to position the lower movable block 16 and the upper movable block 14 in the required position.

The excitation data may be obtained with one or more sensors 66, such as motion sensors on the vessel. As an alternative to measuring actual values, estimates or predictions of the excitation data may serve as input data.

The hoisting assembly data may be obtained with one or more sensors 68, such as position sensors on the upper and lower movable block (not shown). Other hoisting assembly data may be simply input as fixed values, such as the elasticity E and the cross-sectional area A of the first and second ropes 20, 22.

Figure 7A:
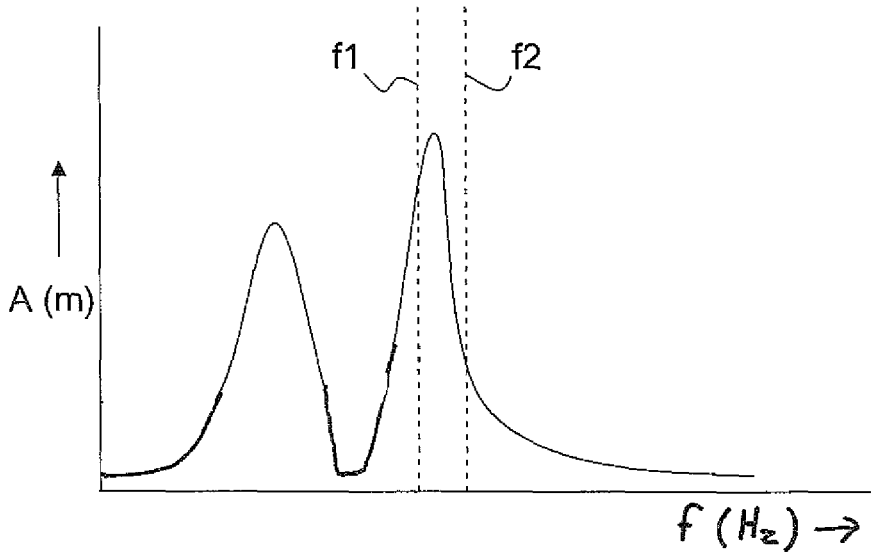
FIGS. 7*a* and 7*b* show frequency domain patterns of the hoisting assembly for different positions of the upper movable block.
Figure 7B:
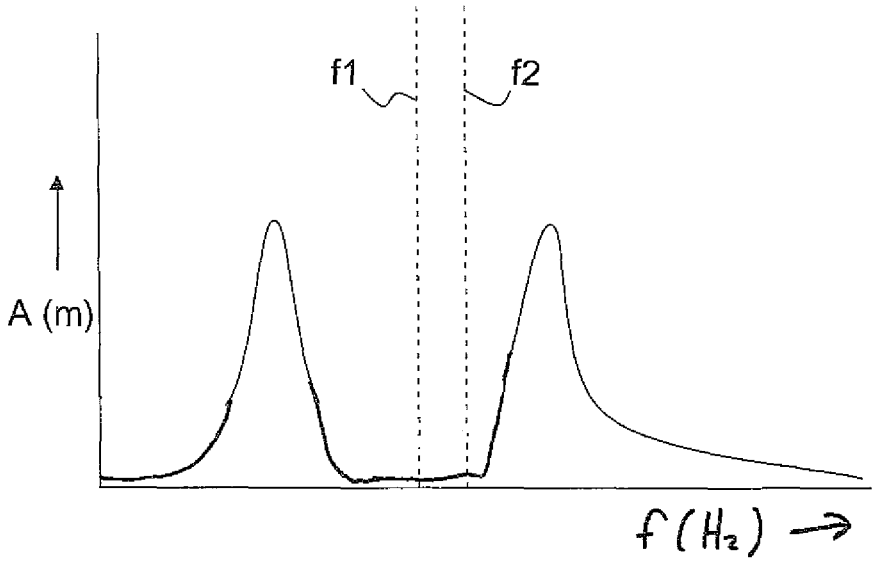

Turning to FIGS. 7*a* and 7*b*, response characteristics in the frequency domain for the hoisting assembly are shown. The response characteristics are determined by the mass of the object to be lifted, the masses of the upper and lower movable blocks 14, 16, the lengths L1 and L2, the elasticity of the first and second ropes, the cross-sectional area of the first and second ropes, the arrangement of the reevings. For a given situation, the hoisting assembly will have a certain motion response characteristic in the frequency domain of excitations.

The amplitude is the vertical movement, measured in meter, of the object to be lifted in response to a frequency of excitations. The system will have high amplitudes A for certain frequencies. A situation may occur that the object has a high amplitude for a certain range of frequencies of excitations f1-f2 which may occur in practice. For instance f1-f2 may be close to the natural frequency of the vessel itself and thus, to the frequency of movement of the fixed block. This is undesired because the object to be lifted may start to resonate. In such a situation, the position of the upper movable block can be changed. This leads to a shift in the response characteristics which is shown in FIG. 7*b*, wherein the response of the system has become much lower in the frequency range between f1 and f2. Resonance of the object to be lifted is thereby substantially reduced.

It will be obvious to a person skilled in the art that the details and the arrangement of the parts may be varied over considerable range without departing from the spirit of the invention and the scope of the claims.

The invention claimed is:

1. A hoisting assembly for lifting or lowering an object, the hoisting assembly comprising:

an upper fixed block;

an upper movable block being suspended from the upper fixed block by at least one first rope which is reeved in one or more first rope lengths between the upper fixed block and the upper movable block;

a lower movable block being connected to the upper movable block by at least one second rope which is reeved in one or more second rope lengths between the lower movable block and the upper movable block, wherein the first and second ropes are reeved in such a way that in use the upper movable block can be positioned at a distance greater than zero from the upper fixed block and at a distance greater than zero from the lower movable block by controlling the lengths of the first and/or second ropes;

the hoisting assembly comprising a data processing unit configured to receive:

excitation data relating to external excitations on the hoisting assembly and hoisting assembly data relating to the response characteristics of the hoisting assembly to external excitations;

wherein the data processing unit is configured to determine a favourable position of the upper movable block between the fixed block and lower movable block on the basis of the excitation data and the hoisting assembly data, which favourable position results in a limited response of the hoisting assembly to a range of external excitations.

2. The hoisting assembly of claim 1, wherein the position of the upper movable block is variable between the upper fixed block and the lower movable block by varying the lengths of the first and/or second ropes.

3. The hoisting assembly of claim 1, wherein the first rope has a different product of its elasticity modulus E multiplied by its cross-sectional surface area A than the second rope.

4. The hoisting assembly of claim 3, wherein the first rope has a different elasticity modulus E than the second rope, or wherein the first rope has a different cross-sectional surface area A than the second rope.

5. The hoisting assembly of claim 1, wherein the first rope is not reeved between the upper movable block and the lower movable block.

6. The hoisting assembly of claim 1, wherein the second rope is not reeved between the upper fixed block and the upper movable block.

7. The hoisting assembly of claim 1, wherein at least one rope length of the second rope extends from the lower movable block directly to the upper fixed block.

8. The hoisting assembly of claim 1, wherein at least one rope length of the second rope extends from the upper fixed block through one or more openings in the upper movable block to the lower movable block, wherein the openings are constructed in order to allow a movement of the second rope through the upper movable block without exerting a substantial vertical force on the upper movable block.

9. The hoisting assembly of claim 1, wherein the data processing unit is configured to receive and process hoisting assembly data further comprising:

a weight of the upper movable block and a weight of the lower movable block;

a weight of the object to be lifted;

an elasticity modulus of the first and second rope;

a cross-sectional area of the first and second rope;

a configuration of the reevings of the first and second rope between the fixed block, the upper movable block and the lower movable block; and a depth of the lower movable block under a water level.

10. The hoisting assembly of claim 9, further comprising:

at least one sensor positioned on the hoisting assembly for measuring excitation data relating to actual excitations on the hoisting assembly and the load which is lifted; and/or an estimate data input configured to receive estimate data relating to predicted or estimated behaviour of wind and waves, currents and/or data relating to a vessel on which the hoisting assembly is positioned, the data processing unit being configured for computing excitation data on the basis of the estimate data and using said excitation data for determining a favourable position of the upper movable block, which favourable position results in a limited vertical resonance of the hoisting assembly to the external excitations.

11. The hoisting assembly of claim 1, wherein the hoisting assembly comprises at least one plate which projects from the upper and/or lower block and which forms a damping mechanism in combination with the surrounding water when the upper and/or lower block moves through the water.

12. A method of lifting or lowering a heavy object, the method comprising:

providing a hoisting assembly comprising:

an upper fixed block;

an upper movable block being suspended from the upper fixed block by at least one first rope which is reeved in one or more first rope lengths between the upper fixed block and the upper movable block; and a lower movable block being connected to the upper movable block by at least one second rope which is reeved in one or more second rope lengths between the lower movable block and the upper movable block, wherein the first and second ropes are reeved in such a way that in use the upper movable block can be positioned at a distance greater than zero from the upper fixed block and at a distance greater than zero from the lower movable block by controlling the lengths of the first and second ropes;

positioning the upper movable block at a predetermined position between the upper fixed block and the lower movable block; and controlling a spring coefficient of the total hoisting assembly between the upper fixed block and the lower movable block by controlling the position of the upper movable block between the upper fixed block and the lower movable block to control the natural frequency of the total system in such a way that the response of the system to a range of frequencies of excitation is reduced.

13. The method of claim 12, further comprising:

varying the position of the upper movable block independently from the position of the lower movable block by varying the lengths of the first and second ropes.

14. The method of claim 12, further comprising:

determining a frequency pattern of the excitations on the hoisting assembly and object which is lifted; and providing the upper movable block at a position which results in a response to the frequency pattern of the excitations which is substantially reduced when compared to at least one other possible position of the upper movable block.

15. The method of claim 12, further comprising:

providing a data processing unit;

inputting excitation data;

inputting hoisting assembly data; and determining a favourable position of the upper movable block between the fixed block and lower movable block on the basis of the excitation data and the hoisting assembly data, which favourable position results in a limited vertical resonance of the hoisting assembly to the external excitations.

16. The method of claim 12, further comprising:

measuring excitation data relating to actual excitations on the hoisting assembly and the load which is lifted; and/or receiving estimate data relating to predicted or estimated behaviour of wind and waves, currents and/or data relating to a vessel on which the hoisting assembly is positioned, and computing excitation data on the basis of the estimate data;

and using the excitation data for computing a favourable position of the upper movable block.

* * * * *